US010810825B2

(12) United States Patent
Nelson et al.

(10) Patent No.: US 10,810,825 B2
(45) Date of Patent: Oct. 20, 2020

(54) SYSTEMS AND METHODS FOR PROVIDING SAFETY AND SECURITY FEATURES FOR USERS OF IMMERSIVE VIDEO DEVICES

(71) Applicant: IGT, Las Vegas, NV (US)

(72) Inventors: Dwayne Nelson, Las Vegas, NV (US); Patrick Danielson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 47 days.

(21) Appl. No.: 16/157,519

(22) Filed: Oct. 11, 2018

(65) Prior Publication Data

US 2020/0118381 A1 Apr. 16, 2020

(51) Int. Cl.
*A63F 9/24* (2006.01)
*G07F 17/32* (2006.01)

(52) U.S. Cl.
CPC ..... *G07F 17/3211* (2013.01); *G07F 17/3216* (2013.01)

(58) Field of Classification Search
CPC ..... G07F 17/3211; G07F 17/3216
See application file for complete search history.

(56) References Cited

U.S. PATENT DOCUMENTS 5,900,849 A * 5/1999 Gallery ..... G06F 3/011 273/148 B
8,235,529 B1 8/2012 Raffle et al.
8,558,759 B1 10/2013 Prada et al.
8,821,274 B2 9/2014 Lyons et al.
8,943,420 B2 1/2015 Goldthwaite et al.
9,280,867 B2 3/2016 Froy et al.
9,280,868 B2 3/2016 Froy et al.
9,285,592 B2 3/2016 Olsson et al.
9,412,201 B2 8/2016 Kinnebrew et al.
9,558,612 B2 1/2017 Lyons et al.
9,568,620 B2 1/2017 Froy et al.
9,569,920 B2 2/2017 Froy et al.
2009/0098925 A1* 4/2009 Gagner ..... G07F 17/32 463/20
2012/0050143 A1* 3/2012 Border ..... G09G 3/3611 345/8
2012/0068913 A1* 3/2012 Bar-Zeev ..... G02B 27/0172 345/8

(Continued)

*Primary Examiner* — Steve Rowland
(74) *Attorney, Agent, or Firm* — Sage Patent Group

(57) ABSTRACT

An immersive video system includes a processor circuit, and a memory coupled to the processing circuit. The memory includes machine-readable instructions that, when executed by the processor circuit, cause the processor circuit to determine a device location of an immersive video device being worn by a user and an electronic game machine (EGM) location for an EGM associated with the user. The memory further includes machine-readable instructions that, when executed by the processor circuit, cause the processor circuit to determine that the immersive video device is obstructing a view of the EGM by the user. The memory further includes machine-readable instructions that, when executed by the processor circuit, cause the processor circuit to determine in response to determining that the immersive video device is obstructing the view of the EGM by the user, disable a feature of the EGM.

20 Claims, 14 Drawing Sheets

(56) References Cited

U.S. PATENT DOCUMENTS

| | | | | |
|---|---|---|---|---|
| 2012/0071237 | A1* | 3/2012 | Cockerille | G07F 17/3211 463/30 |
| 2012/0260307 | A1* | 10/2012 | Sambamurthy | G06F 21/554 726/1 |
| 2013/0222308 | A1* | 8/2013 | Ma | G09G 5/10 345/173 |
| 2013/0328927 | A1* | 12/2013 | Mount | G06T 19/006 345/633 |
| 2014/0002357 | A1* | 1/2014 | Pombo | G06F 3/012 345/158 |
| 2014/0121015 | A1 | 5/2014 | Massing et al. | |
| 2014/0168261 | A1 | 6/2014 | Margolis et al. | |
| 2014/0268054 | A1* | 9/2014 | Olsson | G06F 3/0485 351/209 |
| 2014/0361976 | A1* | 12/2014 | Osman | G02B 27/0172 345/156 |
| 2015/0046296 | A1* | 2/2015 | Hart | G06Q 30/0261 705/27.2 |
| 2015/0199008 | A1* | 7/2015 | Kim | G06F 3/013 345/156 |
| 2016/0077337 | A1* | 3/2016 | Raffle | G06F 3/013 345/156 |
| 2016/0373570 | A1 | 12/2016 | Scavezze et al. | |

* cited by examiner

SYSTEMS AND METHODS FOR PROVIDING SAFETY AND SECURITY FEATURES FOR USERS OF IMMERSIVE VIDEO DEVICES

BACKGROUND

Embodiments described herein relate to systems and methods for providing safety and security features, and in particular to systems and methods for providing safety and security features for users of immersive video devices. Electronic gaming machines (EGMs) are systems that allow users to place a wager on the outcome of a random event, such as the spinning of mechanical or virtual reels or wheels, the playing of virtual cards, the rolling of mechanical or virtual dice, the random placement of tiles on a screen, etc. Manufacturers of EGMs have incorporated a number of enhancements to the EGMs to allow players to interact with the EGMs in new and more engaging ways. For example, early slot machines allowed player interaction by pulling a lever or arm on the machine. As mechanical slot machines were replaced by electronic slot machines, a range of new player interface devices became available to EGM designers and were subsequently incorporated into EGMs. Examples of such interface devices include electronic buttons, wheels, and, more recently, touchscreens and three dimensional display screens. Immersive video devices, such as virtual reality or augmented reality (i.e. mixed reality) devices, may be used to enhance a player's gaming experience. However, a player using an immersive video device may also have difficultly perceiving real-world persons, objects, and events occurring in the around him while using the immersive video device.

BRIEF SUMMARY

According to one embodiment, an immersive video system is disclosed. The immersive video system includes a processor circuit, and a memory coupled to the processing circuit. The memory includes machine-readable instructions that, when executed by the processor circuit, cause the processor circuit to determine a device location of an immersive video device being worn by a user and an electronic game machine (EGM) location for an EGM associated with the user. The memory further includes machine-readable instructions that, when executed by the processor circuit, cause the processor circuit to determine that the immersive video device is obstructing a view of the EGM by the user. The memory further includes machine-readable instructions that, when executed by the processor circuit, cause the processor circuit to determine in response to determining that the immersive video device is obstructing the view of the EGM by the user, disable a feature of the EGM.

According to another embodiment, an immersive video device is disclosed. The immersive video device includes a head-wearable frame, a display coupled to the head-wearable frame, a processor circuit, a communication interface coupled to the processor circuit, and a memory coupled to the processor circuit. The memory includes machine-readable instructions that, when executed by the processor circuit cause the processor circuit to determine a device location of the immersive video device and an electronic game machine (EGM) location for an EGM associated with a user wearing the immersive video device. The memory further includes machine-readable instructions that, when executed by the processor circuit, cause the processor circuit to determine that the immersive video device is obstructing a view of the EGM by the user. The memory further includes machine-readable instructions that, when executed by the processor circuit, cause the processor circuit to, in response to determining that the immersive video device is obstructing the view of the EGM by the user, transmit an instruction to the EGM via the communication interface to disable a feature of the EGM.

According to another embodiment, a method is disclosed. The method includes determining, by a processor circuit, a device location of an immersive video device being worn by a user and an electronic game machine (EGM) location for an EGM associated with the user. The method further includes determining, by the processor circuit, that the immersive video device is obstructing a view of the EGM by the user. The method further includes, in response to determining that the immersive video device is obstructing the view of the EGM by the user, disabling a feature of the EGM.

DETAILED DESCRIPTION

Embodiments described herein relate to systems and methods for providing safety and security features, and in particular to systems and methods for providing safety and security features for users of immersive video devices. According to some embodiments, an immersive video system includes a processor circuit, and a memory coupled to the processing circuit. The memory includes machine-readable instructions that, when executed by the processor circuit, cause the processor circuit to determine a device location of an immersive video device being worn by a user and an electronic game machine (EGM) location for an EGM associated with the user. The memory further includes machine-readable instructions that, when executed by the processor circuit, cause the processor circuit to determine that the immersive video device is obstructing a view of the EGM by the user. The memory further includes machine-readable instructions that, when executed by the processor circuit, cause the processor circuit to determine in response to determining that the immersive video device is obstructing the view of the EGM by the user, disable a feature of the EGM.

These and other embodiments provide safety and security features to a user of an immersive video device by preventing and/or inhibiting the ability of unauthorized persons to interact with or interfere with the EGM while the user is using the immersive video device. For example, one technical problem with conventional immersive video systems is that it is difficult for a user to fully immerse himself in the virtual environment of the immersive video experience because of concerns about real-world persons, objects, or activities around him, such as potential interference with other devices that the user cannot immediately or easily perceive. One technical solution to this problem is to disable features of surrounding devices, such as a display device, an input device, a graphical user interface (GUI) or GUI element, or a cashout feature of an EGM, for example, while the user is using the immersive video device. As a result, the user may have less reason to worry about the real-world persons, objects, or activities around him and can more easily immerse himself in the virtual environment of the immersive video experience.

Figure 1:
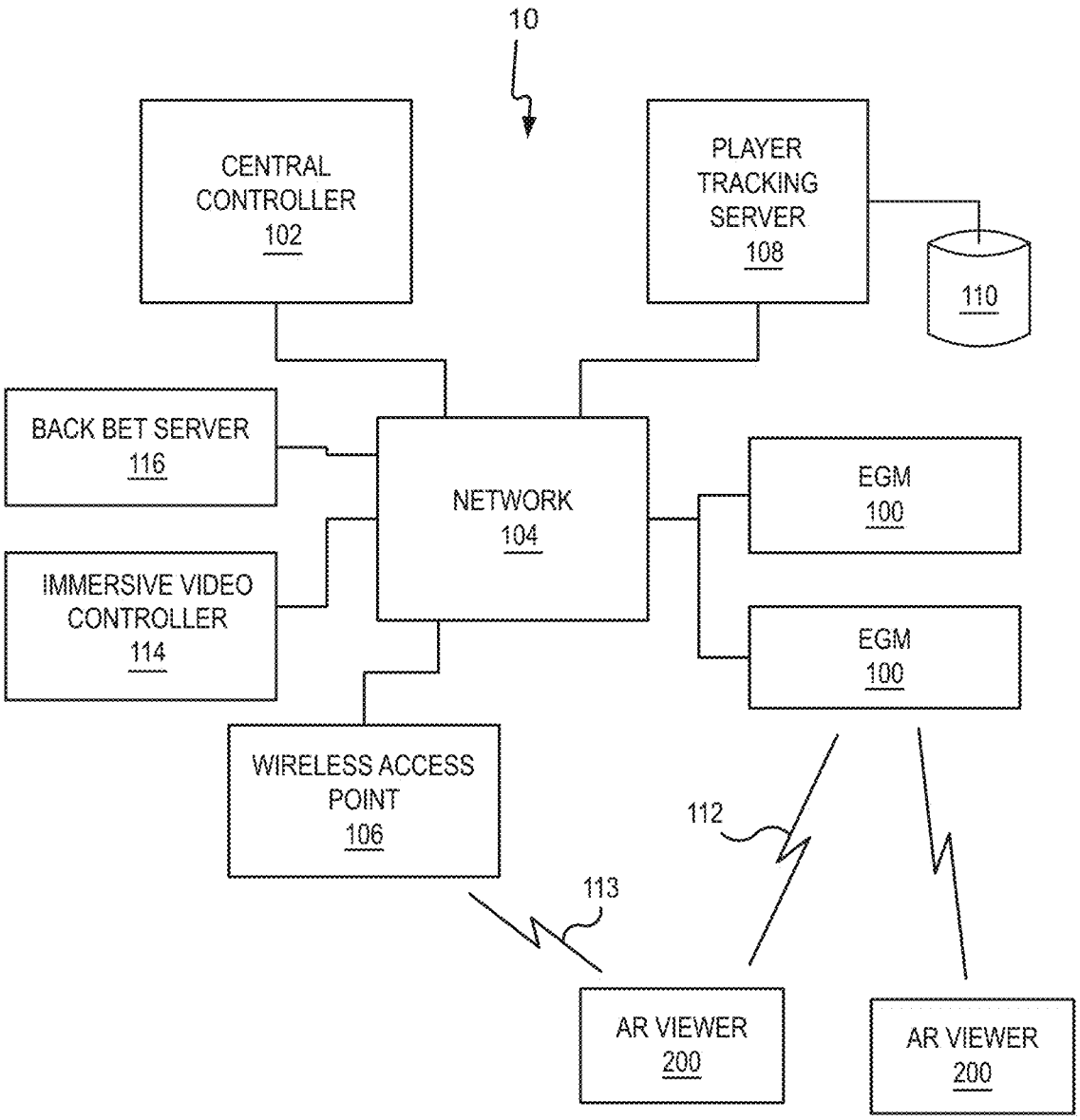
FIG. 1 is a schematic block diagram illustrating a network configuration for a plurality of gaming devices according to some embodiments.

Referring now to FIG. 1, a gaming system 10 including a plurality of EGMs 100 is illustrated. The gaming system 10 may be located, for example, on the premises of a gaming establishment, such as a casino. The EGMs 100, which are typically situated on a casino floor, may be in communication with each other and/or at least one central controller 102 through a data network or remote communication link 104. The data communication network 104 may be a private data communication network that is operated, for example, by the gaming facility that operates the EGM 100. Communications over the data communication network 104 may be encrypted for security. The central controller 102 may be any suitable server or computing device which includes at least one processor circuit (such as a microprocessor or other processor, for example) and at least one memory or storage device. Each EGM 100 may include a processor circuit that transmits and receives events, messages, commands or any other suitable data or signal between the EGM 100 and the central controller 102. The EGM processor circuit is operable to execute such communicated events, messages or commands in conjunction with the operation of the EGM. Moreover, the processor circuit of the central controller 102 is configured to transmit and receive events, messages, commands or any other suitable data or signal between the central controller 102 and each of the individual EGMs 100. In some embodiments, one or more of the functions of the central controller 102 may be performed by one or more EGM processor circuits. Moreover, in some embodiments, one or more of the functions of one or more EGM processor circuits as disclosed herein may be performed by the central controller 102.

A wireless access point 106 provides wireless access to the data communication network 104. The wireless access point 106 may be connected to the data communication network 104 as illustrated in FIG. 1, or may be connected directly to the central controller 102 or another server connected to the data communication network 104.

A player tracking server 108 may also be connected through the data communication network 104. The player tracking server 108 may manage a player tracking account that tracks the player's gameplay and spending and/or other player preferences and customizations, manages loyalty awards for the player, manages funds deposited or advanced on behalf of the player, and other functions. Player information managed by the player tracking server 108 may be stored in a player information database 110.

As further illustrated in FIG. 1, an immersive video viewer 200 is provided. The immersive video viewer 200 may be a virtual reality (VR) viewer or other device that provides a fully immersive VR scene entirely composed of virtual elements and that occupies a user's entire field of view. The immersive video viewer 200 may alternatively be a mixed reality, or augmented reality (AR), viewer or other device that provides a mixed reality scene composed of real-world elements from a real-world scene in a user's field of view along with virtual elements that obscure or replace certain real-world elements in the scene.

The immersive video viewer 200 communicates with one or more elements of the system 10 to render two dimensional (2D) and/or three dimensional (3D) content to a player of one of the EGMs 100 in a virtual space. In some embodiments, the immersive video viewer 200 may be further configured to enable the player to interact with the virtual elements displayed to the player by the immersive video viewer 200.

The immersive video viewer 200 communicates with one or more elements of the system 10 to coordinate the rendering of immersive video images, and in some embodiments immersive video 3D images, to the player. For example, in some embodiments, the immersive video viewer 200 may communicate directly with an EGM 100 over a wireless interface 112, which may be a WiFi link, a Bluetooth link, an NFC link, etc. In other embodiments, the immersive video viewer 200 may communicate with the data communication network 104 (and devices connected thereto, including EGMs) over a wireless interface 113 with the wireless access point 106. The wireless interface 113 may include a WiFi link, a Bluetooth link, an NFC link, etc. In still further embodiments, the immersive video viewer 200 may communicate simultaneously with both the EGM 100 over the wireless interface 112 and the wireless access point 106 over the wireless interface 113. In these embodiments, the wireless interface 112 and the wireless interface 113 may use different communication protocols and/or different communication resources, such as different frequencies, time slots, spreading codes, etc. For example, in some embodiments, the wireless interface 112 may be a Bluetooth link, while the wireless interface 113 may be a WiFi link.

The wireless interfaces 112, 113 allow the immersive video viewer 200 to coordinate the generation and rendering of immersive video images to the player via the immersive video viewer 200.

In some embodiments, the gaming system 10 includes an immersive video controller 114. The immersive video controller 114 may be a computing system that communicates through the data communication network 104 with the EGMs 100 and the immersive video viewers 200 to coordinate the generation and rendering of virtual images to one or more players using the immersive video viewers 200. The immersive video controller 114 may be implemented within or separately from the central controller 102. In some embodiments, the immersive video controller 114 may be a VR controller, a mixed reality (or AR) controller, or both.

In some embodiments, the immersive video controller 114 may coordinate the generation and display of the virtual images of the same virtual object to more than one player by more than one immersive video viewer 200. As described in more detail below, this may enable multiple players to interact with the same virtual object together in real time. This feature can be used to provide a shared multiplayer experience to multiple players at the same time.

Moreover, in some embodiments, the immersive video controller 114 may coordinate the generation and display of the same virtual object to players at different physical locations, as will be described in more detail below.

The immersive video controller 114 may store a three dimensional wireframe map of a gaming area, such as a casino floor, and may provide the three dimensional wireframe map to the immersive video viewers 200. The wireframe map may store various information about EGMs in the gaming area, such as the identity, type and location of various types of EGMs. The three dimensional wireframe map may enable the immersive video viewer 200 to more quickly and accurately determine its position and/or orientation within the gaming area, and also may enable the immersive video viewer 200 to assist the player in navigating the gaming area while using the immersive video viewer 200. The generation of three dimensional wireframe maps is described in more detail below.

In some embodiments, at least some processing of virtual images and/or objects that are rendered by the immersive video viewers 200 may be performed by the immersive video controller 114, thereby offloading at least some processing requirements from the immersive video viewers 200.

A back bet server 116 may be provided to manage back bets placed using an immersive video viewer 200 as described in more detail below. An immersive video viewer 200 may communicate with the back bet server 116 through the wireless interface 113 and network 104.

Referring to FIGS. 2A to 2D, the immersive video viewer 200 may be implemented in a number of different ways. For example, referring to FIG. 2A. in some embodiments, an immersive video viewer 200A may be implemented as a 3D headset including a pair of lenses 218 coupled to a head-wearable frame, on which images of virtual objects may be displayed within a field of view of a user wearing the frame. Different stereoscopic images may be displayed on the lenses 218 to create an appearance of depth, while the semitransparent nature of the lenses 218 allow the user to see both the real-world as well as the 3D image rendered on the lenses 218. The immersive video viewer 200A may be implemented, for example, using a Hololens™ from Microsoft Corporation. The Microsoft Hololens includes a plurality of cameras and other sensors 220 that the device uses to obtain a live video signal for building a 3D model of the space around the user. The viewer 200A can generate a 3D image to display to the user that takes into account the real-world objects around the user and allows the user to interact with the 3D object. In mixed reality embodiments, the lenses 218 may be semi-transparent to allow the user to also perceive real-world elements along with the virtual elements as part of a mixed reality scene. In VR embodiments, the lenses 218 may be selectively or permanently opaque, semi-opaque, reflective or refractive, as desired, so that the real-world elements are obscured and/or replaced by the virtual elements in the user's entire field of view.

The viewer 200A may further include other sensors, such as a gyroscopic sensor, a GPS sensor, one or more accelerometers, and/or other sensors that allow the viewer 200A to determine its position and orientation in space. In further embodiments, the viewer 200A may include one or more cameras that allow the viewer 200A to determine its position and/or orientation in space using visual simultaneous localization and mapping (VSLAM). The viewer 200A may further include one or more microphones and/or speakers that allow the user to interact audially with the device.

Figure 2A:
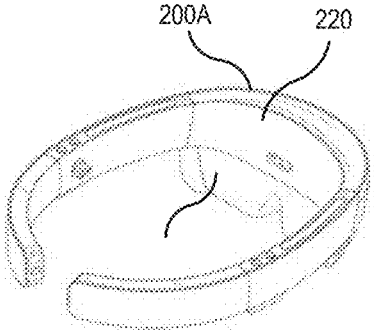
FIGS. 2A to 2D illustrate immersive video viewers according to various embodiments.
Figure 2B:
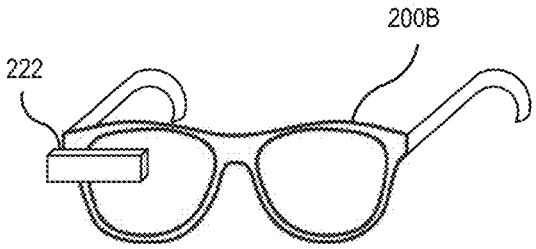

Referring to FIG. 2B, an immersive video viewer 200B may be implemented as a pair of glasses including a transparent prismatic display 222 that displays an image to a single eye of the user. An example of such a device is the Google Glass device. Such a device may be capable of displaying images to the user while allowing the user to see the world around the user, and as such can be used as a mixed reality viewer. However, it will be appreciated that the viewer 200B may be incapable of displaying 3D images to the user.

Figure 2C:
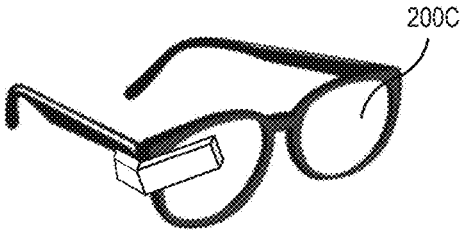
Figure 2D:
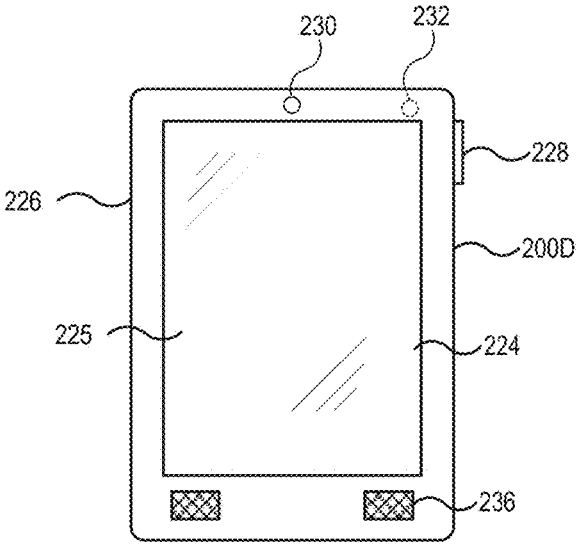

In other embodiments, referring to FIG. 2C, the immersive video viewer may be implemented using a virtual retinal display device 200C. In contrast to devices that display an image within the field of view of the user, a virtual retinal display raster scans an image directly onto the retina of the user. Like the viewer 200B, the virtual retinal display device 200C combines the displayed image with surrounding light to allow the user to see both the real-world and the displayed image. However, also like the viewer 200B, the virtual retinal display device 200C may be incapable of displaying 3D images to the user.

In still further embodiments, an immersive video viewer 200D may be implemented using a mobile wireless device, such as a mobile telephone, a tablet computing device, a personal digital assistant, or the like. The viewer 200D may be a handheld device including a housing 226 on which a touchscreen display device 224 including a digitizer 225 is provided. An input button 228 may be provided on the housing and may act as a power or control button. A rear facing camera 230 or other video capture device may be provided in a front face of the housing 226. The viewer 200D may further include a front facing camera 232 or other video capture device on a rear face of the housing 226. The viewer 200D may include one or more speakers 236 and a microphone 234. The viewer 200D may provide an immersive video display by capturing a video signal using the front facing camera 232 and displaying the video signal on the display device 224, and also displaying a rendered image of a virtual object over the captured video signal. In this manner, the user may see both a mixed image of both a real object in front of the viewer 200D as well as a virtual object superimposed over the real object to provide a mixed reality viewing experience.

Figure 3A:
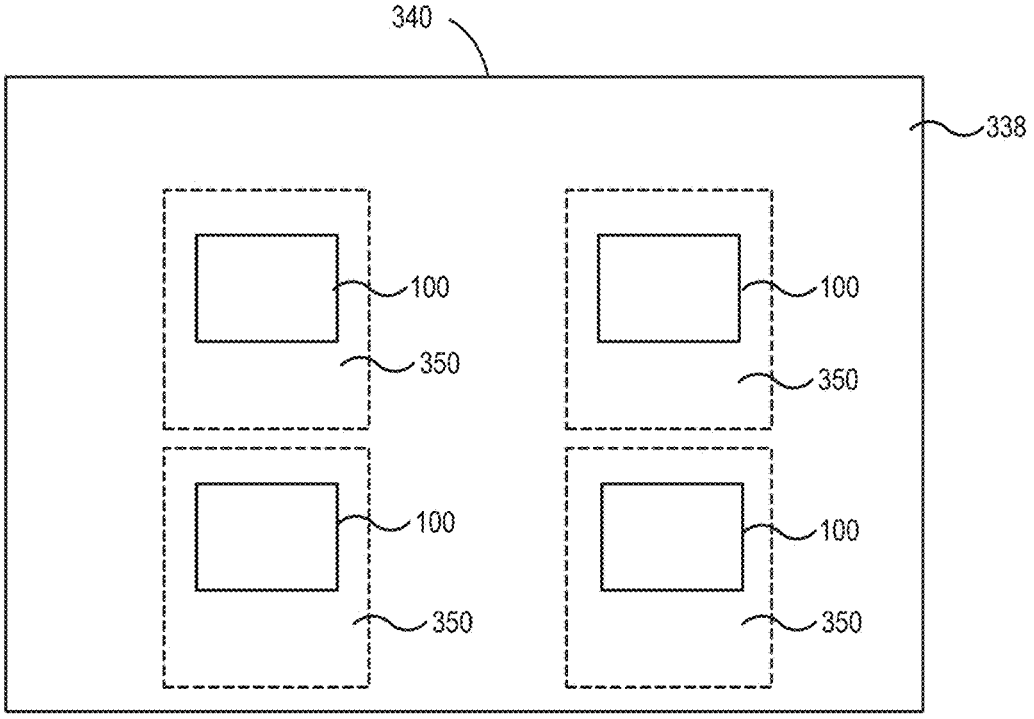
FIG. 3A is a map of a gaming area, such as a casino floor, including a plurality of gaming devices and authorized regions for providing immersive video content.

FIG. 3A illustrates, in plan view, an example map 338 of a gaming area 340. The gaming area 340 may, for example, be a casino floor. The map 338 shows the location of a plurality of EGMs 100 within the gaming area 340. As will be appreciated, the locations of the EGMs 100 within a gaming area 340 are generally fixed, although a casino operator may relocate EGMs from time to time, such as when new EGMs are introduced, to create new traffic flow patterns within the gaming area 340, to feature or highlight certain games, etc. In this example, each EGM 100 is located within a predetermined region 350 within the gaming area 340. Each predetermined region 350 may be indicated by real-world elements, such as signage, floor markings, lighting, or other elements, to indicate the presence and/or boundaries of the predetermined region 350. The real-world elements may be conspicuous, so as to call attention to the predetermined region 350, inconspicuous, so as to allow a person seeking out the predetermined region 350 to perceive its presence and/or boundaries, or may be invisible or hidden, so as to be detectable only by the immersive video viewer 200 or other devices. As noted above, in order to assist the operation of the immersive video viewers 200, the immersive video controller 114 may store a three dimensional wireframe map of the gaming area 340, and may provide the three dimensional wireframe map to the immersive video viewers 200. In some embodiments, the three dimensional wireframe map may be generated dynamically, such as by surveying the gaming area 340 with the immersive video viewers 200 in real time to build a wireframe model for the three dimensional wireframe map.

Figure 3B:
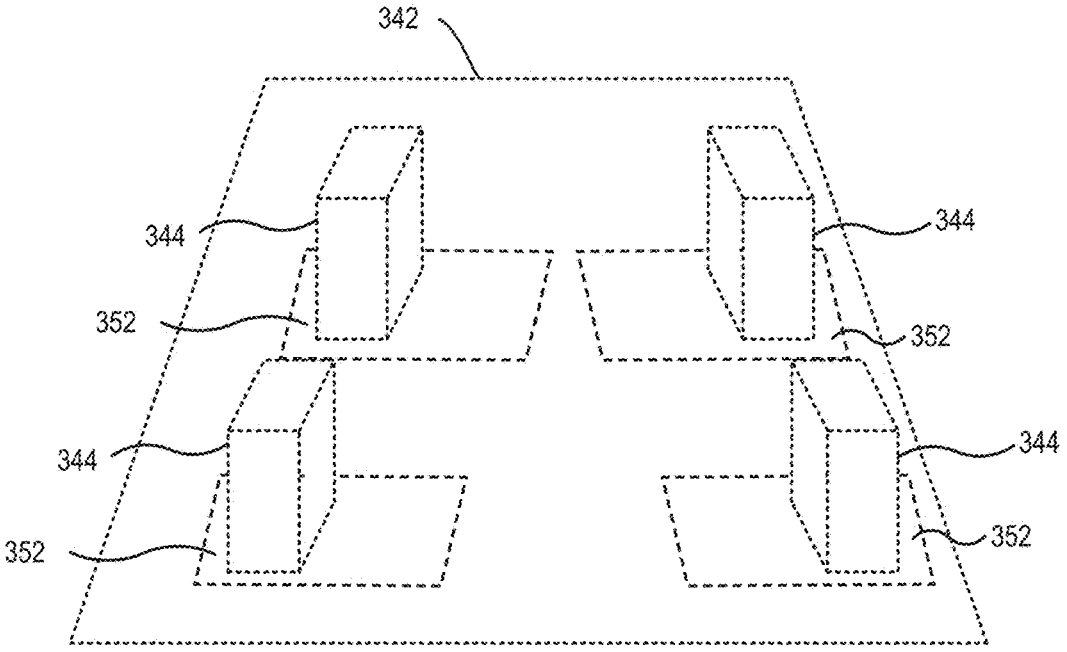
FIG. 3B is a 3D wireframe model of the gaming area of FIG. 3A.

An example of a wireframe map 342 is shown in FIG. 3B. The wireframe map 342 is a three-dimensional model of the gaming area 340. As shown in FIG. 3B, the wireframe map 342 includes wireframe EGM models 344 corresponding to the EGMs 100 that are physically in the gaming area 340, and includes wireframe predetermined region models 352 corresponding to the predetermined regions 350 surrounding the EGMs 100 in the gaming area 340. The wireframe EGM models 344 and wireframe predetermined region models 352 may be pregenerated to correspond to various EGM form factors, such as single display EGMs, mechanical slot EGMs, dual display EGMs, etc. The pregenerated models may then be placed into the wireframe map, for example, by a designer or other personnel. The wireframe map 342 may be updated whenever the physical locations of EGMs 100 and/or predetermined regions 350 in the gaming area 340 are changed.

In some embodiments, the wireframe map 342 may be generated automatically using an immersive video viewer 200, such as a 3D headset, that is configured to perform a three-dimensional depth scan of its surroundings and generate a three dimensional model based on the scan results. Thus, for example, an operator using an immersive video viewer 200A (FIG. 2A) may perform a walkthrough of the gaming area 340 while the immersive video viewer 200A builds the 3D map of the gaming area.

The three dimensional wireframe map 342 may enable an immersive video viewer 200 to more quickly and accurately determine its position and/or orientation within the gaming area. For example, an immersive video viewer 200 may determine its location within the gaming area 340 using one or more position/orientation sensors. The immersive video viewer 200 then builds a three dimensional map of its surroundings using depth scanning, and compares its sensed location relative to objects within the generated three dimensional map with an expected location based on the location of corresponding objects within the wireframe map 342. The immersive video viewer 200 may calibrate or refine its position/orientation determination by comparing the sensed position of objects with the expected position of objects based on the wireframe map 342. Moreover, because the immersive video viewer 200 has access to the wireframe map 342 of the entire gaming area 340, the immersive video viewer 200 can be aware of objects or destinations within the gaming area 340 that it has not itself scanned. Processing requirements on the immersive video viewer 200 may also be reduced because the wireframe map 342 is already available to the immersive video viewer 200.

In some embodiments, the wireframe map 342 may store various information about EGMs in the gaming area, such as the identity, type, orientation and location of various types of EGMs, the locations of exits, bathrooms, courtesy desks, cashiers, ATMs, ticket redemption machines, etc. Such information may be used by an immersive video viewer 200 to help the user navigate the gaming area. For example, if a user desires to find a destination within the gaming area, the user may ask the immersive video viewer 200 for directions using a built-in microphone and voice recognition function in the immersive video viewer 200 or use other hand gestures or eye/gaze controls tracked by the immersive video viewer 200 (instead of or in addition to voice control). The immersive video viewer 200 may process the request to identify the destination, and then may display a virtual object, such as a virtual path on the ground, virtual arrow, virtual sign, etc., to help the user to find the destination. In some embodiments, for example, the immersive video viewer 200 may display a halo or glow around the destination to highlight it for the user, or have virtual 3D sounds coming from it so players could more easily find the machine.

According to some embodiments, a user of an immersive video viewer 200 may use the immersive video viewer to obtain information about players and/or EGMs on a casino gaming floor. The information may be displayed to the user on the immersive video viewer 200 in a number of different ways such as by displaying images on the immersive video viewer 200 that appear to be three dimensional or two dimensional elements of the scene as viewed through the immersive video viewer 200. In general, the type and/or amount of data that is displayed to the user may depend on what type of user is using the immersive video viewer 200 and, correspondingly, what level of permissions or access the user has. For example, an immersive video viewer 200 may be operated in one of a number of modes, such as a player mode, an observer mode or an operator mode. In a player mode, the immersive video viewer 200 may be used to display information about particular EGMs on a casino floor. The information may be generic information about an EGM or may be customized information about the EGM based on the identity or preferences of the user of the immersive video viewer 200. In an observer mode, the immersive video viewer 200 may be used to display information about particular EGMs on a casino floor or information about players of EGMs on the casino floor. In an operator mode, the immersive video viewer 200 may also be used to display information about particular EGMs on a casino floor or information about players of EGMs on the casino floor, but the information may be different or more extensive than the information displayed to an observer. Each of these situations is described in more detail below.

Figure 4A:
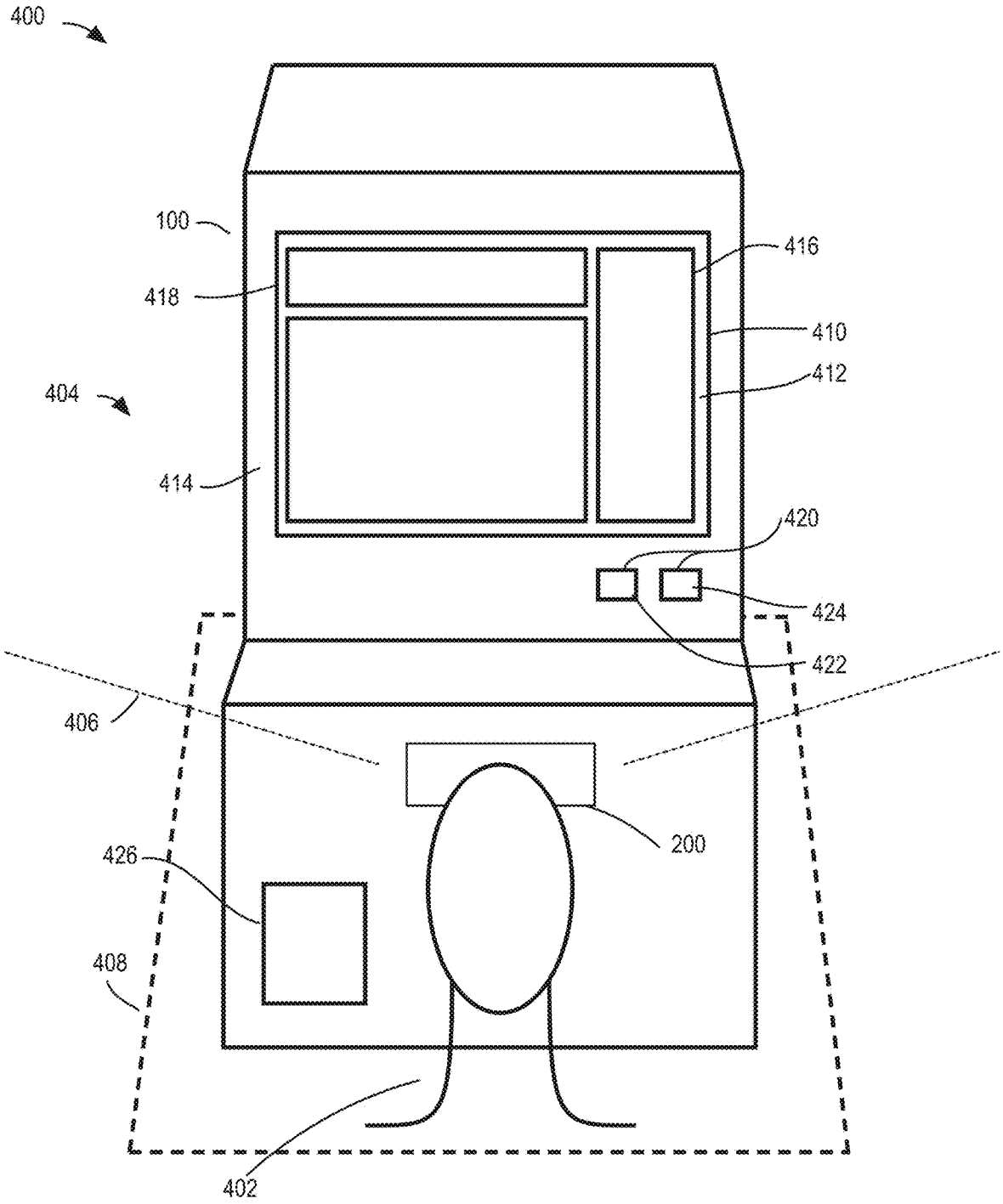
FIG. 4A is a diagram of a real-world scene including an EGM and a user of an immersive video device within a region surrounding the EGM.
Figure 4B:
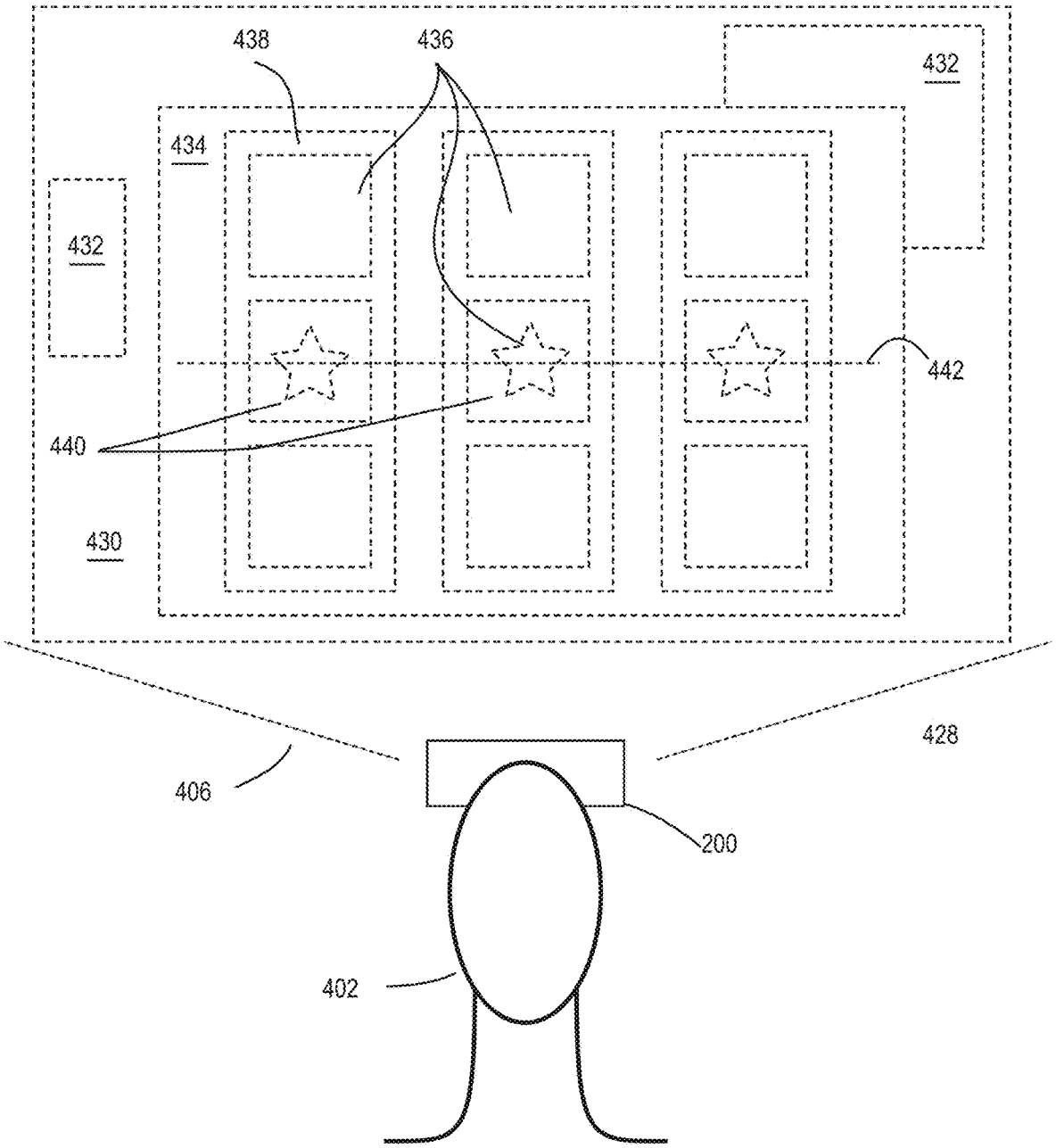
FIG. 4B is a diagram illustrating an immersive video scene including virtual elements viewable by the user of the immersive video device, which may prevent the user form viewing some or all of the real-world elements of FIG. 4A.
Figure 4C:
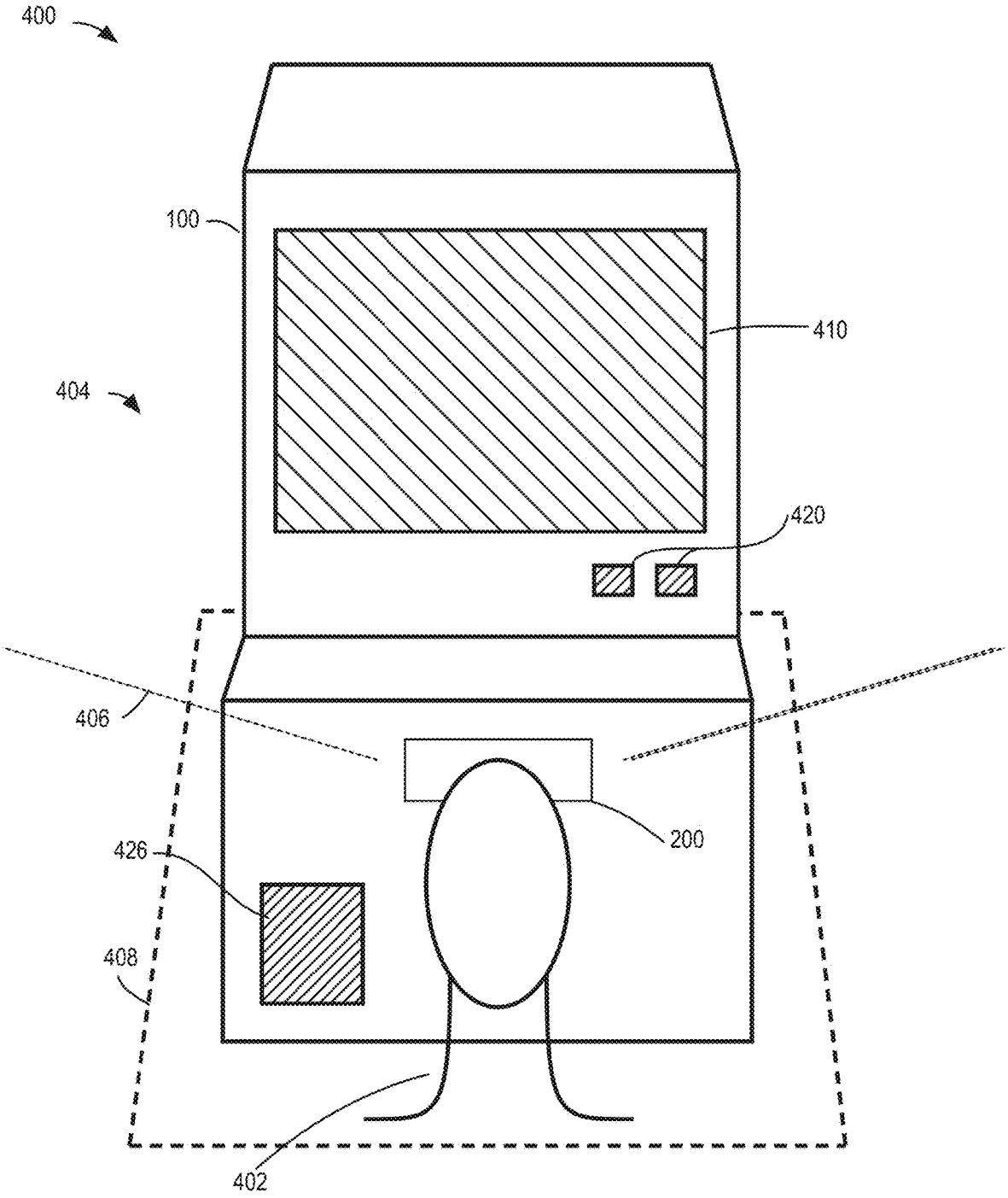
FIG. 4C is a diagram of the real-world scene of FIG. 4A in which certain features of the EGM are disabled while the user is using the immersive video device.

Referring now to FIGS. 4A-4C, FIG. 4A is a diagram of a real-world scene including an EGM and a user of an immersive video device within a region surrounding the EGM. FIG. 4B is a diagram illustrating an immersive video scene including virtual elements viewable by the user of the immersive video device, which may prevent the user form viewing some or all of the real-world elements of FIG. 4A. FIG. 4C is a diagram of the real-world scene of FIG. 4A in which certain features of the EGM are disabled while the user is using the immersive video device.

In FIG. 4A, an immersive video system 400 includes an EGM 100 and an immersive video viewer 200 that may be worn by a user 402. In this example, the immersive video viewer which 200 may provide immersive gaming or other content associated with gaming or other content being provided by the EGM 100. A real-world scene 404 is defined by a field of view 406 of the user 402, corresponding to the real-world elements that are viewable by the user 402 from a particular location. In this example, a predetermined region 408 surrounds the EGM 100 and corresponds to a region in which immersive video content may be provided via the immersive video viewer 200.

The EGM 100 has a number of functions that may be used as standalone functions or may be used in association with functions of the immersive video viewer 200, as desired. For example, the EGM may include an EGM display 410 having a graphical user interface (GUI) 412 having game elements, player information, and/or other information. The EGM 100 may include input elements 420, such as a bet button 422 or a cashout button 424, for example. In some embodiments, a lockable storage compartment 426 may be included as part of the EGM 100 or associated with the EGM (e.g., as part of a seat attached to the EGM 100).

If the user 402 begins wearing the immersive video viewer 200 and/or activates features of the immersive video viewer 200, the user 402 may no longer be able to see some or all of the real-world elements in the real-world scene 404, such as the display 410, input elements 420, and/or storage compartment 426, for example. Instead, referring now to FIG. 4B, the user 402 may be presented with a virtual scene 428, which may occupy some or all of the field of view 406 of the user 402. The virtual scene 428 may include a virtual backdrop 430, which may include virtual environmental elements 432 that may obscure or replace real-world elements from the real-world scene 404 of FIG. 4A in the field of view 406 of the user 402. The virtual scene 428 may include a virtual game interface 434 having a plurality of virtual game elements 436. In this example, the virtual game elements 436 include virtual reels 438, virtual game symbols 440, and/or virtual paylines 442 as part of a slot game, but it should be understood that any number of different virtual game elements 436 corresponding to different types of games may be used.

Referring now to FIG. 4C, a diagram of the real-world scene of FIG. 4A is illustrated, in which certain features of the EGM 100 are disabled while the user 402 is using the immersive video viewer 200. The system, via EGM 100, immersive video viewer 200, or other components of the system 400, may determine that the user 402 wearing the immersive video viewer 200 at a particular device location, e.g., that the immersive video viewer 200 is at a location proximate to the EGM 100. The system 400 may determine that the immersive video viewer 200 is obstructing a view of the EGM 100 by the user 402. For example, the system 400 may determine that a portion of the field of view 406 of the user 402 is blocked by a display of the immersive video viewer 200 so that the user 402 is unable to perceive elements of the real-world scene 404, such the EGM 100 or components thereof. In response to determining that the immersive video viewer 200 is obstructing a view of the EGM 100 by the user 402, the system 400 may disable one or more features of the EGM 100.

For example, the system 400 may disable the display 410 of the EGM 100. The system 400 may disable the entire display 410, or may disable particular elements of the GUI 412 of FIG. 4A, such as the game elements, the player information elements 416, and/or other information elements 418 of the GUI 412.

In another example, the system 400 may also or alternatively disable certain input elements 420 of the EGM 100, such as a bet button 422, or a cashout button 424.

In another example, the system may system 400 may also or alternatively cause the lockable storage compartment 426 to be locked. At the conclusion of the immersive video content, the system 400 may transmit an instruction to unlock the storage compartment 426. Alternatively, the storage compartment 426 may remain locked until the user 402 chooses to manually unlock the storage compartment 426, e.g., by entering a PIN or swiping a key card.

Figure 5A:
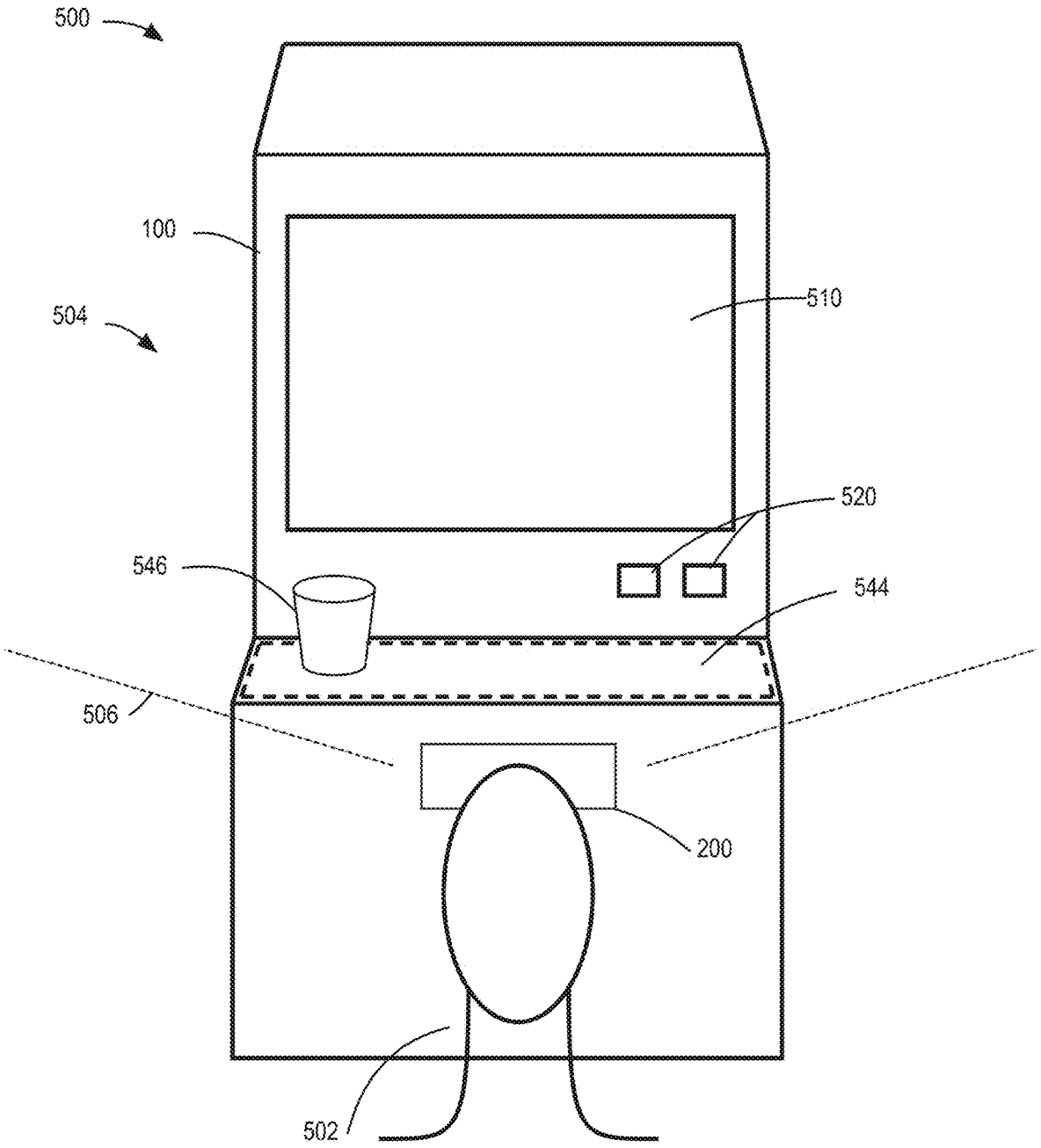
FIG. 5A is a diagram of a real-world scene including an EGM and a user of an immersive video device within a region surrounding the EGM, wherein an obstruction is detected within the region surrounding the EGM.
Figure 5B:
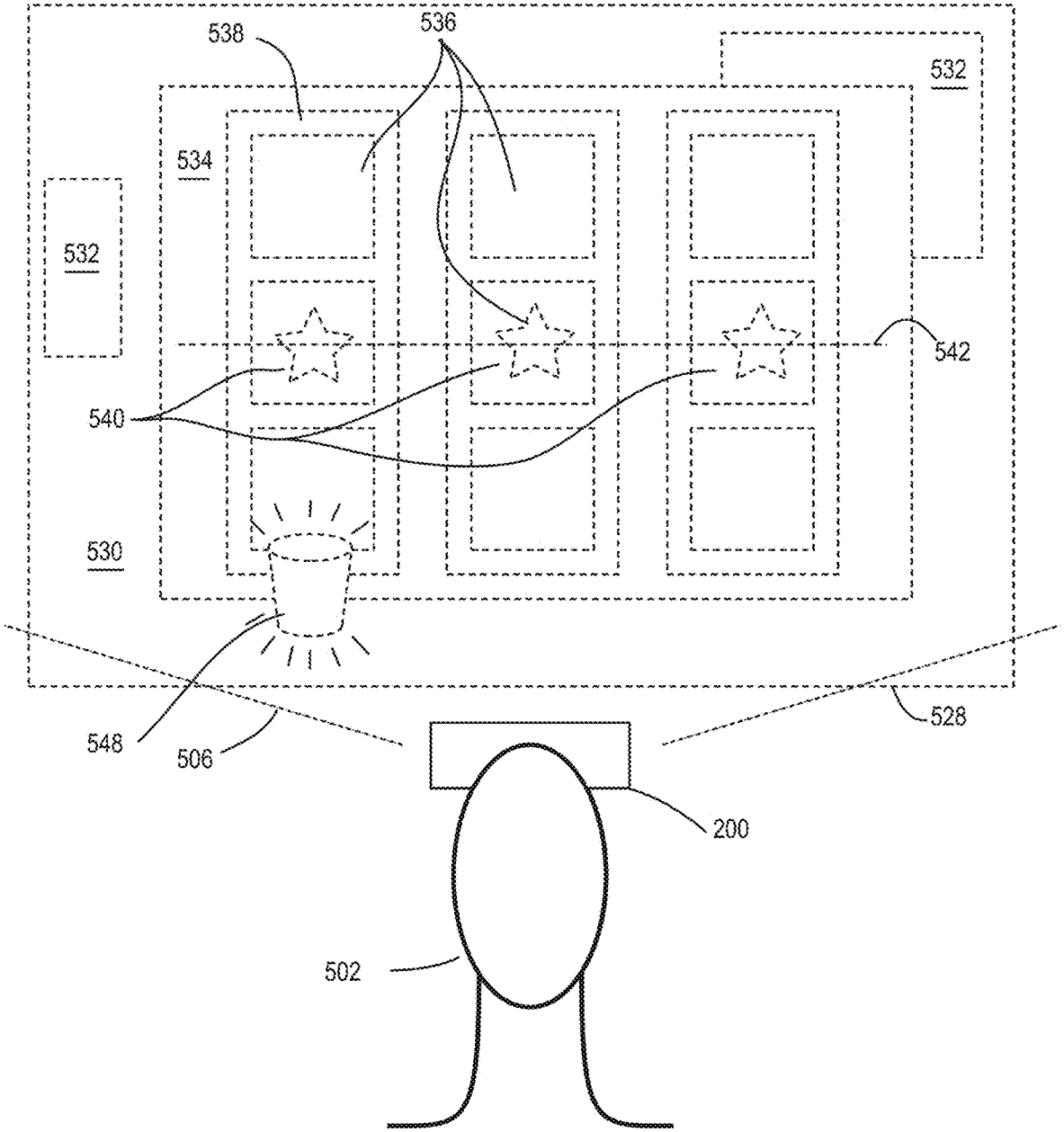
FIG. 5B is a diagram illustrating an immersive video scene including virtual elements viewable by the user of the immersive video device, including a virtual element indicative of the obstruction within the region surrounding the EGM of FIG. 5A.

In some embodiments, a user may receive an indication within a virtual scene corresponding to a real-world element in the real-world scene. In this regard, FIG. 5A is a diagram of a real-world scene including an EGM and a user of an immersive video device within a region surrounding the EGM, wherein an obstruction is detected within the region surrounding the EGM. FIG. 5B is a diagram illustrating an immersive video scene including virtual elements viewable by the user of the immersive video device, including a virtual element indicative of the obstruction within the region surrounding the EGM of FIG. 5A.

In FIG. 5A, an immersive video system 500 includes an EGM 100 and an immersive video viewer 200 that may be worn by a user 502. In this example, the immersive video viewer which 200 may provide immersive gaming or other content associated with gaming or other content being provided by the EGM 100. A real-world scene 504 is defined by a field of view 506 of the user 502, corresponding to the real-world elements that are viewable by the user 502 from a particular location. The EGM 100 may include a display 510, input elements 520, and other elements, as described above. The EGM 100 in this embodiment may also include physical features, such as a deck 544, that may be suitable for resting a drink 546, for example, during use of the EGM 100 and/or the immersive video viewer 200.

Referring now to FIG. 5B, the user 502 of the immersive video viewer 200 may be presented with a virtual scene 528, which may occupy some or all of the field of view 506 of the user 502. The virtual scene 528 may include a virtual backdrop 530, which may include virtual environmental elements 532, and a virtual game interface 534 having a plurality of virtual game elements 536, similar to the virtual scene 428 of FIG. 4B, for example.

In the virtual scene 528 of FIG. 5B, some of the virtual environmental elements 532 and/or virtual game elements 536 (such as virtual reels 538, virtual game symbols 540, and/or virtual paylines 542, for example) may correspond to physical features of the EGM 100 and/or surrounding physical objects that may be proximate to the user 502 during use of the EGM 100 and/or immersive video viewer 200. This may allow the user 502 to move around within a predetermined area without avoid inadvertently contacting or otherwise interacting with real-world objects. However, when additional real-world objects are introduced, such as the drink 546 of FIG. 5A, there is a danger of the user 502 accidentally interacting with the object. This unanticipated interaction may break the sense of immersion for the user 502, and may also cause a mishap, such as accidentally knocking over and spilling the drink 546. In another example, a user 502 may not realize another person has approached the EGM 100 and the user 502 may be startled by suddenly realizing that another person is present. The user 502 may also not be able to perceive if a malicious person attempts to interact with the EGM 100, such as to bet, cash out, or otherwise perform unauthorized activity at the EGM 100 without the user's 502 knowledge. It is also possible for these unanticipated interactions to have more serious consequences, such as property damage, injury or death, due to the inability of the user 502 to perceive and/or react to real-world objects and/or events while wearing the immersive video viewer 200.

In the embodiment of FIGS. 5A and 5B, the system 500 detects the presence of an obstruction within a predetermined area around the EGM 100, i.e., the drink 546 resting on the deck 544 of the EGM 100. The obstruction may be detected, for example, by an image capture device, e.g., a camera, associated with the EGM 100, the immersive video viewer 200, or another component of the system 500. Other sensors for detecting the presence of an object may include pressure sensors, infrared camera sensors, temperature sensors, motion sensors, or other sensors, as desired. The system 500 then provides an indication 548 to the user in the virtual scene 528 of FIG. 5B that the obstruction is in the predetermined area around the EGM 100. In this example, the indication 548 is a visual indication that approximates the appearance and location of the drink 546 in the real-world scene 504 as part of the virtual scene 528. It should be understood, however, that other types of indications may be provided, as desired. For example, a visual indication may have a different appearance, such as an object consistent with a game theme, that still conveys to the user 502 that an obstruction is present. The indication 548 may be a generic alert indication, and may also or alternatively include an audio or haptic alert element. For example, the indication 548 may notify the user 502 to stop moving, suspend the immersive video content and/or present a live view of the real-world scene so that the user 502 can perceive his surroundings and avoid unintentional interaction with the real-world objects. Alternatively, the system 500 may prevent the immersive video viewer 200 from presenting the virtual scene 528 until the obstruction is removed, and provide the indication 548 to inform the user 502 that the obstruction must be removed for the virtual scene 528 to be presented.

The system 500 may also detect the presence of another person, and may similarly provide an indication to the user 502 that a person is present proximate to the EGM 100. The persons may similarly be detected, for example, by an image capture device, e.g., a camera, associated with the EGM 100, the immersive video viewer 200, or another component of the system 500.

Figure 6:
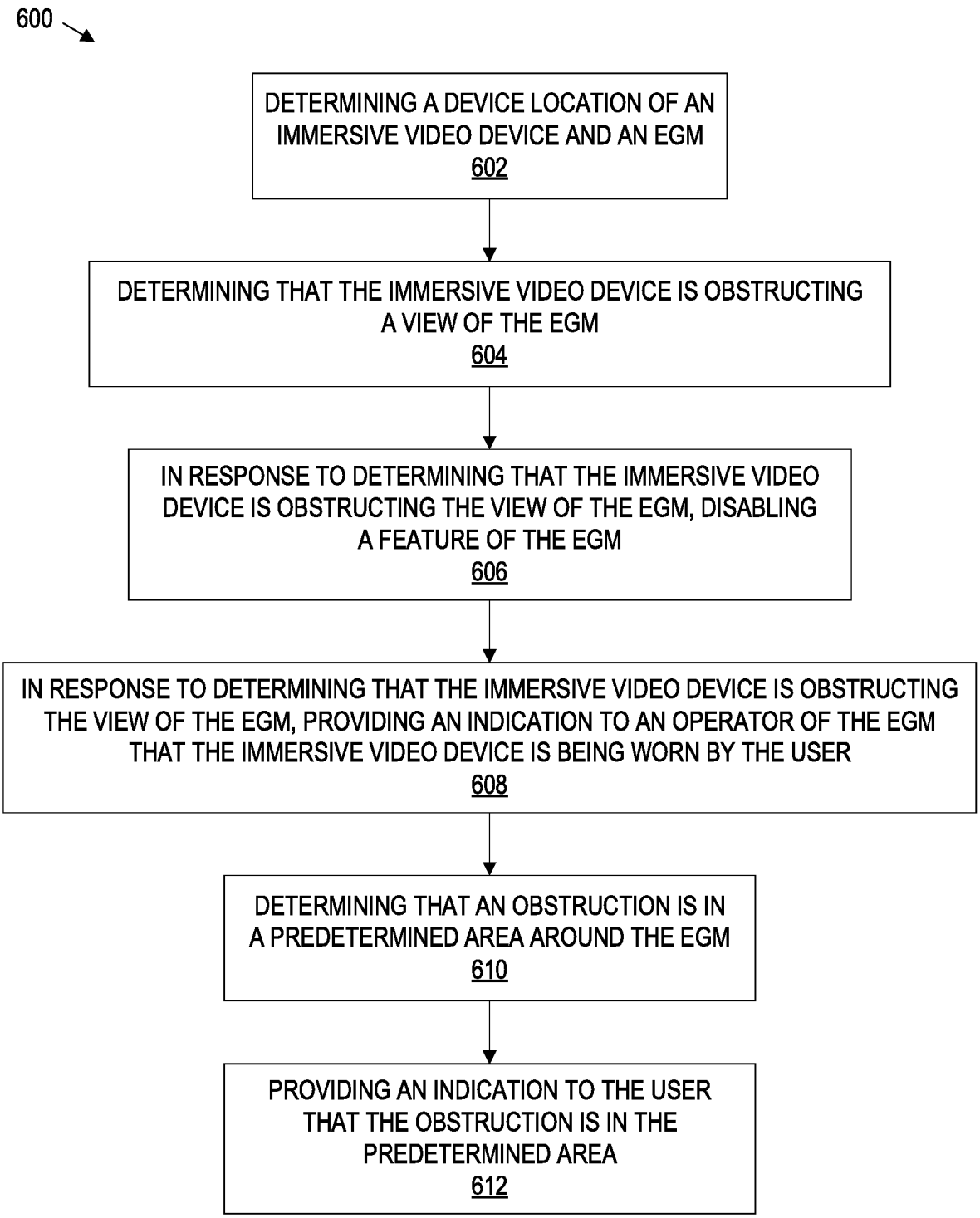
FIG. 6 is a flowchart illustrating operations of systems/methods according to some embodiments.

Referring now to FIG. 6, a flowchart illustrates operations of systems/methods according to some embodiments. The operations 600 include determining, by a processor circuit, a device location of an immersive video device being worn by a user and an electronic game machine (EGM) location for an EGM associated with the user (Block 602).

The operations 600 further include determining, by the processor circuit, that the immersive video device is obstructing a view of the EGM by the user (Block 604). Determining that the immersive video device is obstructing a view of the EGM by the user may include detecting that the immersive video device is being worn by the user, such as by a forehead sensor or other sensor, and may further include detecting a movement of the immersive video device, such as by an accelerometer or other sensor on or associated with the immersive video device.

The operations 600 further include, in response to determining that the immersive video device is obstructing the view of the EGM by the user, disabling a feature of the EGM (Block 606). Disabling the feature of the EGM may include disabling a display device of the EGM, disabling an input device of the EGM, disabling a graphical interface feature of the EGM, disabling a cashout feature of the EGM, and/or disabling a service feature of the EGM, for example.

The operations 600 may further include, in response to determining that the immersive video device is obstructing the view of the EGM by the user, providing an indication to an operator of the EGM that the immersive video device is being worn by the user (Block 608). For example, for a user using an immersive video viewer with an EGM in a casino, a visual indication on or proximate to the EGM, such as a light, may illuminate, thereby notifying game operators and casino staff that the user is using the immersive video viewer, making it less likely that the user will be disturbed or startled during use of the immersive video viewer. Alternatively, or in addition, an indication may be transmitted to an operator device. The indication may cause service actions, such as delivery of a drink order for example, to be delayed until the user has stopped using the immersive video viewer.

The operations 600 may further include, determining that an obstruction is in a predetermined area around the EGM (Block 610), such as a drink for example, and providing an indication to the user that the obstruction is in the predetermined area around the EGM (Block 612), so that the user does not inadvertently interact with the obstruction. The indication may be a virtual element displayed to the user by the immersive video viewer, such as a virtual element in a virtual location with respect to the EGM within an immersive video scene that corresponds to a real-world location of the obstruction.

As noted above, these and other operations may be performed by systems, devices, or components thereof, including standalone devices or system components such as an EGM, an immersive video viewer, a server, or a controller, or by combinations thereof, as desired.

Figure 7A:
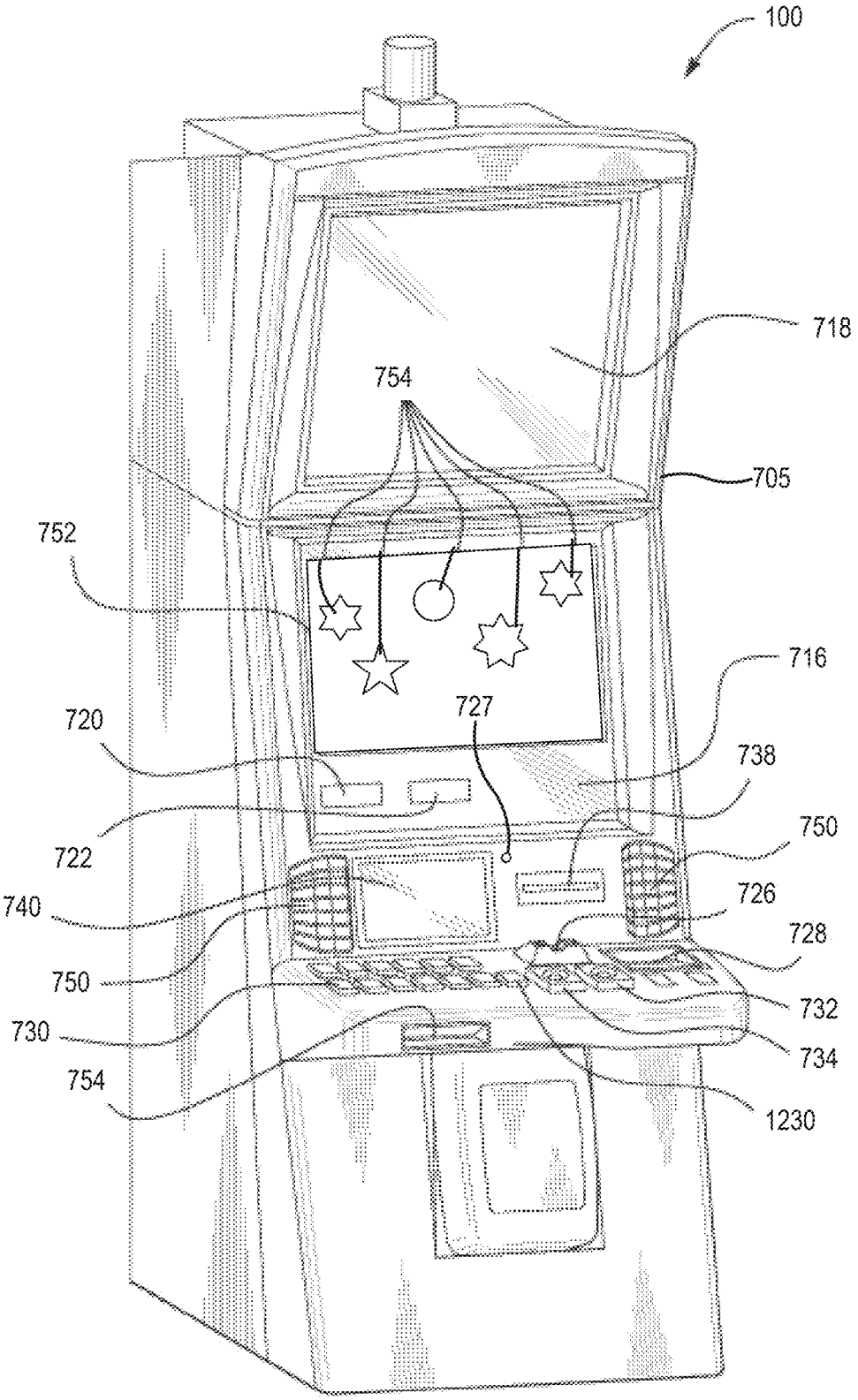
FIG. 7A is a perspective view of an electronic gaming device that can be configured according to some embodiments.
Figure 7B:
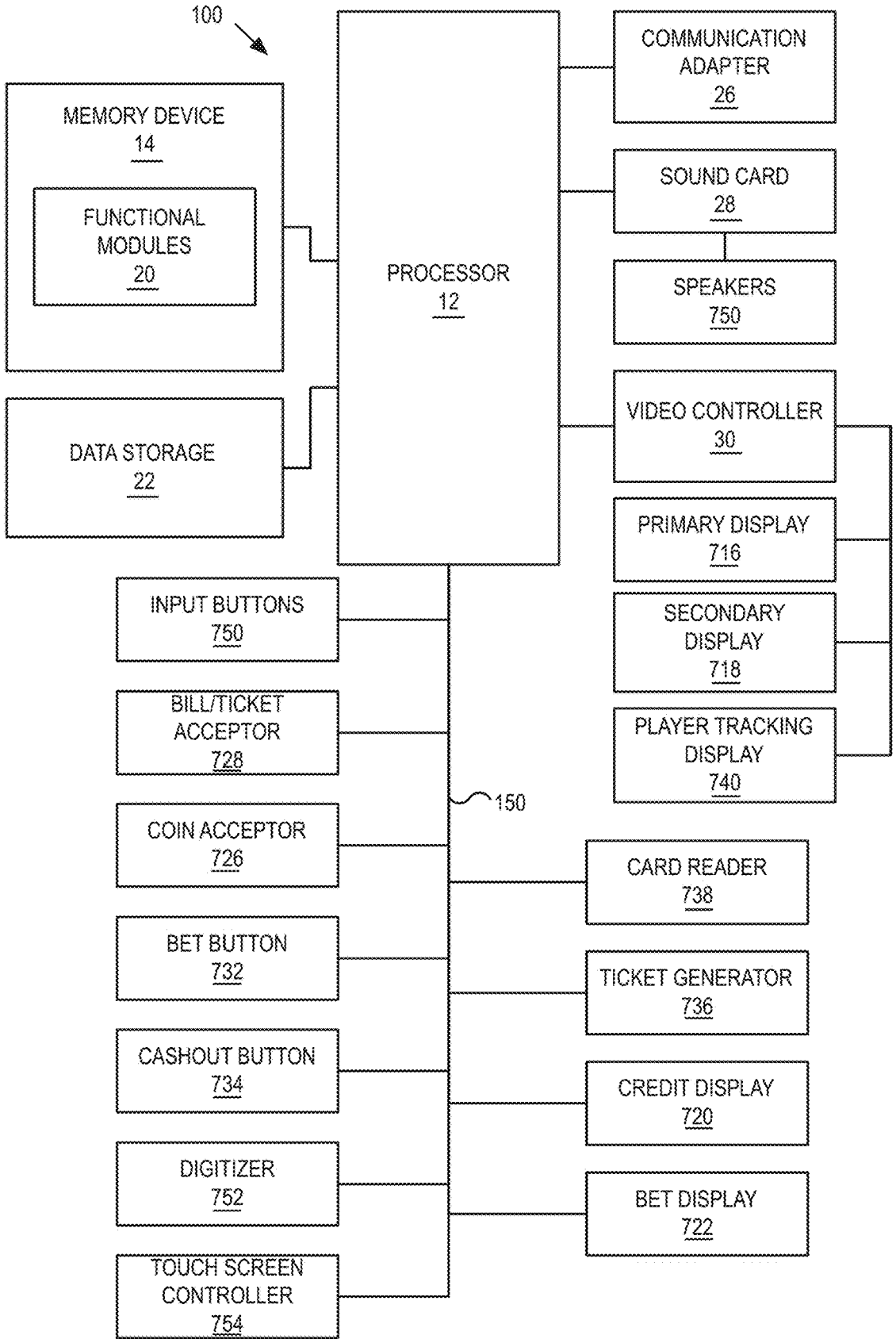
FIG. 7B is a schematic block diagram illustrating an electronic configuration for a gaming device according to some embodiments.
Figure 7C:
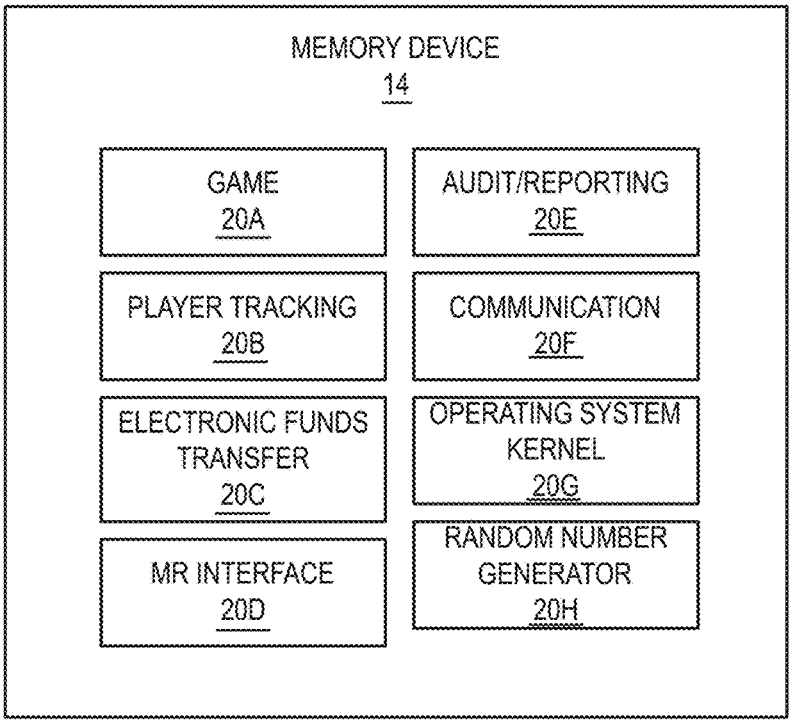
FIG. 7C is a block diagram that illustrates various functional modules of an electronic gaming device according to some embodiments.

An example of an electronic gaming machine (EGM) that can interact with immersive video viewers according to various embodiments is illustrated in FIGS. 7A, 7B, and 7C in which FIG. 7A is a perspective view of an EGM 100 illustrating various physical features of the device, FIG. 7B is a functional block diagram that schematically illustrates an electronic relationship of various elements of the EGM 100, and FIG. 7C illustrates various functional modules that can be stored in a memory device of the EGM 100. The embodiments shown in FIGS. 7A to 7C are provided as examples for illustrative purposes only. It will be appreciated that EGMs may come in many different shapes, sizes, layouts, form factors, and configurations, and with varying numbers and types of input and output devices, and that embodiments are not limited to the particular EGM structures described herein.

EGMs may include a number of standard features, many of which are illustrated in FIGS. 7A and 7B. For example, referring to FIG. 7A, an EGM 100 may include a support structure, cabinet, or housing 705 which provides support for a plurality of displays, inputs, outputs, controls and other features that enable a player to interact with the EGM 100.

The EGM 100 illustrated in FIG. 7A includes a number of display devices, including a primary display device 716 located in a central portion of a housing 705 (e.g., a cabinet)

and a secondary display device 718 located in an upper portion of the housing 705. It will be appreciated that one or more of the display devices 716, 718 may be omitted, or that the display devices 716, 718 may be combined into a single display device. The EGM 100 may further include a player tracking display 740, a credit display 720, and a bet display 722. The credit display 720 displays a player's current number of credits, cash, account balance or the equivalent. The bet display 722 displays a player's amount wagered.

The player tracking display 740 may be used to display a service window that allows the player to interact with, for example, their player loyalty account to obtain features, bonuses, comps, etc. In other embodiments, additional display screens may be provided beyond those illustrated in FIG. 7A.

The EGM 100 may further include a number of input devices that allow a player to provide various inputs to the EGM 100, either before, during or after a game has been played. For example, the EGM 100 may include a plurality of input buttons 730 that allow the player to select options before, during or after game play. The EGM may further include a game play initiation button 732 and a cashout button 734. The cashout button 734 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 7A and 7B includes a game play activation device in the form of a game play initiation button 732. It should be appreciated that, in other embodiments, the EGM 100 begins game play automatically upon appropriate funding rather than upon utilization of the game play activation device.

In some embodiments, one or more input devices of the EGM 100 are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may a touch-sensitive display that includes a digitizer 752 and a touchscreen controller 754 (FIG. 7B). The player may interact with the EGM 100 by touching virtual buttons on one or more of the display devices 716, 718, 740. Accordingly, any of the above described input devices, such as the input buttons 730, the game play initiation button 732 and/or the cashout button 734 may be provided as virtual buttons on one or more of the display devices 716, 718, 740.

Referring briefly to FIG. 7B, operation of the primary display device 716, the secondary display device 718 and the player tracking display 740 may be controlled by a video controller 30 that receives video data from a processor circuit 12 or directly from a memory device 14 and displays the video data on the display screen. The credit display 720 and the bet display 722 are typically implemented as simple LCD or LED displays that display a number of credits available for wagering and a number of credits being wagered on a particular game. Accordingly, the credit display 720 and the bet display 722 may be driven directly by the processor circuit 12. In some embodiments however, the credit display 720 and/or the bet display 722 may be driven by the video controller 30.

Referring again to FIG. 7A, the display devices 716, 718, 740 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 716, 718, 740 may include a touch-screen with an associated touchscreen controller 754 and digitizer 752. The display devices 716, 718, 740 may be of any suitable size, shape, and/or configuration. The display devices 716, 718, 740 may include flat or curved display surfaces.

The display devices 716, 718, 740 and video controller 30 of the EGM 100 are generally configured to display one or more game and/or non-game images, symbols, and indicia. In certain embodiments, the display devices 716, 718, 740 of the EGM 100 are configured to display any suitable visual representation or exhibition of the movement of objects; dynamic lighting; video images; images of people, characters, places, things, and faces of cards; and the like. In certain embodiments, the display devices 716, 718, 740 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 716, 718, 740 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include a ticket generator 736, a bill/ticket acceptor 728, and a coin acceptor 726 that allows the player to deposit coins into the EGM 100.

While not illustrated in FIG. 7A, the EGM 100 may also include a payment mechanism, which may include a coin and/or bill acceptor, a coin and/or bill dispenser, an electronic card reader including a magnetic and/or chip-based reader, and/or a wireless reader including a near-field communication (NFC), Bluetooth, Wi-Fi, or other type of wireless interface, for example.

The EGM 100 may further include one or more speakers 750 controlled by one or more sound cards 28 (FIG. 7B). The EGM 100 illustrated in FIG. 7A includes a pair of speakers 750. In other embodiments, additional speakers, such as surround sound speakers, may be provided within or on the housing 705. Moreover, the EGM 100 may include built-in seating with integrated headrest speakers.

In various embodiments, the EGM 100 may generate dynamic sounds coupled with attractive multimedia images displayed on one or more of the display devices 716, 718, 740 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 738 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processor circuit determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 7B is a block diagram that illustrates logical and functional relationships between various components of an EGM 100. As shown in FIG. 7B, the EGM 100 may include a processor circuit 12 that controls operations of the EGM 100. Although illustrated as a single processor circuit, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processor circuit 12 may be variously referred to as a "controller," "microcontroller," "microprocessor" or simply a "computer." The processor circuit may further include one or more application-specific integrated circuits (ASICs).

Various components of the EGM 100 are illustrated in FIG. 7B as being connected to the processor circuit 12. It will be appreciated that the components may be connected to the processor circuit 12 through a system bus 150, a communication bus and controller, such as a USB controller and USB bus, a network interface, or any other suitable type of connection.

The EGM 100 further includes a memory device 14 that stores one or more functional modules 20. Various functional modules 20 of the EGM 100 will be described in more detail below in connection with FIG. 7D.

The memory device 14 may store program code and instructions, executable by the processor circuit 12, to control the EGM 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage device 22 may store program data, player data, audit trail data or any other type of data. The data storage device 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processor circuit 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processor circuit 12 through a universal serial bus (USB) hub (not shown) connected to the processor circuit 12. U.S. Patent Application Publication No. 2004/0254014 describes a variety of EGMs including one or more communication ports that enable the EGMs to communicate and operate with one or more external peripherals.

In some embodiments, the EGM 100 may include a video capture device, such as a camera in communication with the processor circuit 12 (and possibly controlled by the processor circuit 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 716, 718, 740 may be configured to display the image acquired by the camera as well as display the visible manifestation of the game in split screen or picture-in-picture fashion. For example, the camera may acquire an image of the player and the processor circuit 12 may incorporate that image into the primary and/or secondary game as a game image, symbol or indicia.

Various functional modules of that may be stored in a memory device 14 of an EGM 100 are illustrated in FIG. 7C. Referring to FIG. 7C, the EGM 100 may include in the memory device 14 a game module 20A that includes program instructions and/or data for operating a hybrid wagering game as described herein. The EGM 100 may further include a player tracking module 20B, an electronic funds transfer module 20C, a wide area progressive module 20D, an audit/reporting module 20E, a communication module 20F, an operating system 20G and a random number generator 20H. The player tracking module 20B keeps track of the play of a player. The electronic funds transfer module 20C communicates with a back end server or financial institution to transfer funds to and from an account associated with the player. The wide area progressive (WAP) interface module 20D interacts with a remote WAP server to enable the EGM 100 to participate in a wide area progressive jackpot game as described in more detail below. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

In some embodiments, an EGM 100 may be implemented by a desktop computer, a laptop personal computer, a personal digital assistant (PDA), portable computing device, or other computerized platform. In some embodiments, the EGM 100 may be operable over a wireless network, such as part of a wireless gaming system. In such embodiments, the gaming machine may be a hand held device, a mobile device or any other suitable wireless device that enables a player to play any suitable game at a variety of different locations. It should also be understood that a gaming device or gaming machine as disclosed may include mechanical or electromechanical elements. Some game devices or game machines may facilitate play at a live table game, with the game device playing virtually at a live table game having otherwise real-world elements. It should be appreciated that a gaming device or gaming machine as disclosed herein may be a device that has obtained approval from a regulatory gaming commission or a device that has not obtained approval from a regulatory gaming commission.

Figure 7D:
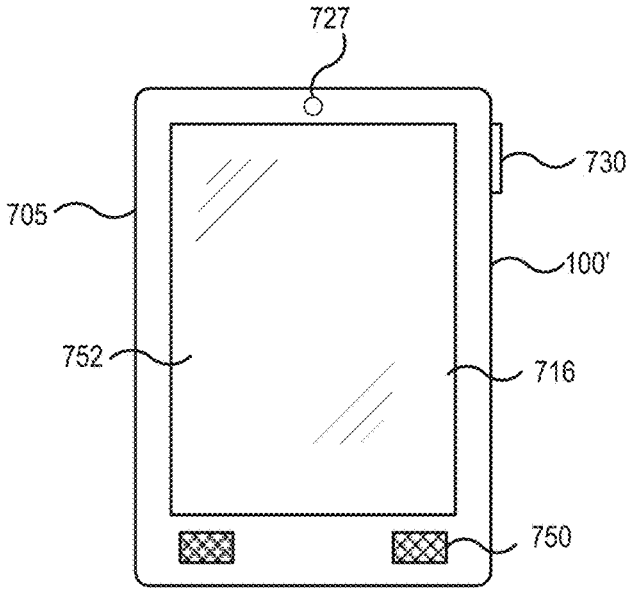
FIG. 7D is perspective view of a handheld electronic gaming device that can be configured according to some embodiments.

For example, referring to FIG. 7D, an EGM 100' may be implemented as a handheld device including a compact housing 705 on which is mounted a touchscreen display device 716 including a digitizer 752. An input button 730 may be provided on the housing and may act as a power or control button. A camera 727 may be provided in a front face of the housing 705. The housing 705 may include one or more speakers 750. In the EGM 100', various input buttons described above, such as the cashout button, gameplay activation button, etc., may be implemented as soft buttons on the touchscreen display device 716. Moreover, the EGM 100' may omit certain features, such as a bill acceptor, a ticket generator, a coin acceptor or dispenser, a card reader, secondary displays, a bet display, a credit display, etc. Credits can be deposited in or transferred from the EGM 100' electronically.

Figure 7E:
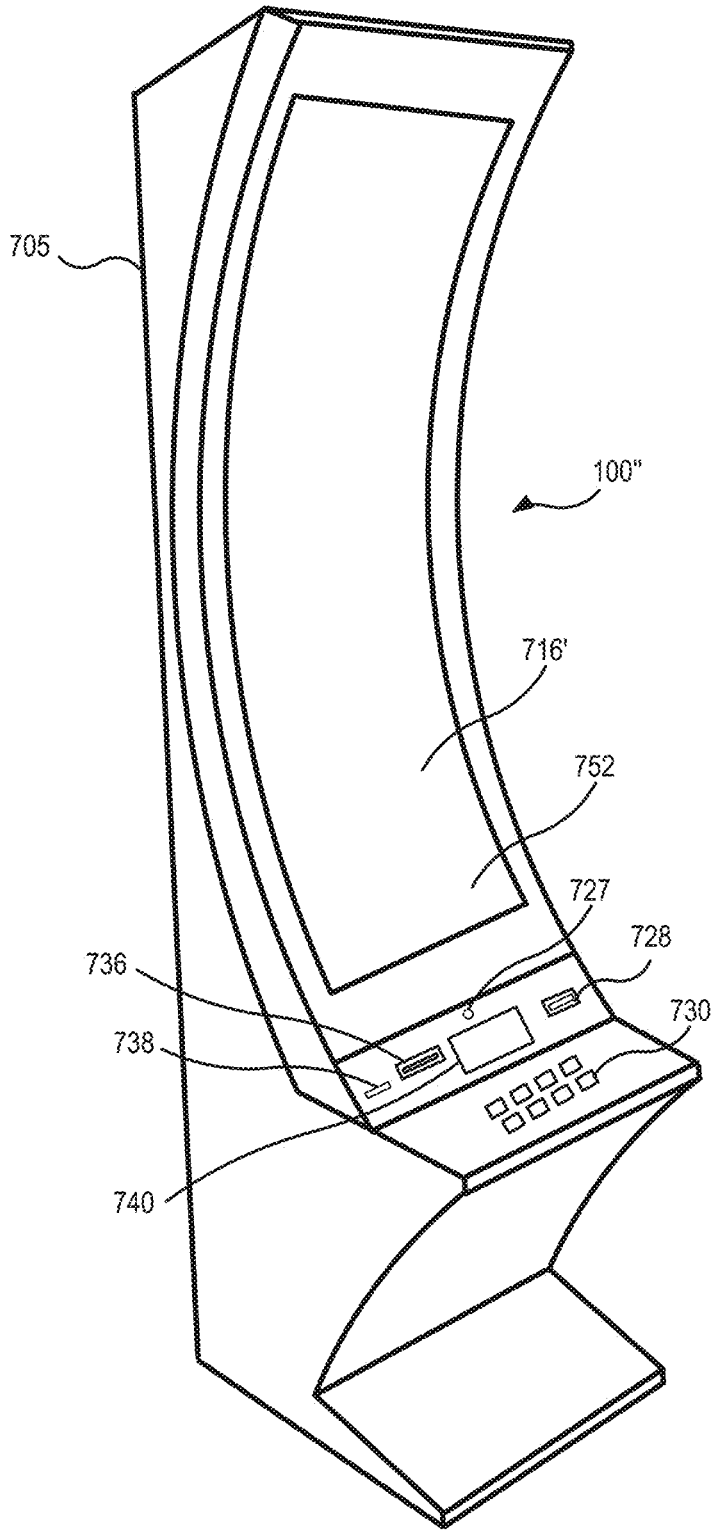
FIG. 7E is a perspective view of an electronic gaming device according to further embodiments.

FIG. 7E illustrates a standalone EGM 100" having a different form factor from the EGM 100 illustrated in FIG. 7A. In particular, the EGM 100" is characterized by having a large, high aspect ratio, curved primary display device 716' provided in the housing 705, with no secondary display device. The primary display device 716' may include a digitizer 752 to allow touchscreen interaction with the primary display device 716'. The EGM 700" may further include a player tracking display 740, a plurality of input buttons 730, a bill/ticket acceptor 728, a card reader 738, and a ticket generator 736. The EGM 100" may further include one or more cameras 727 to enable facial recognition and/or motion tracking.

Figure 8:
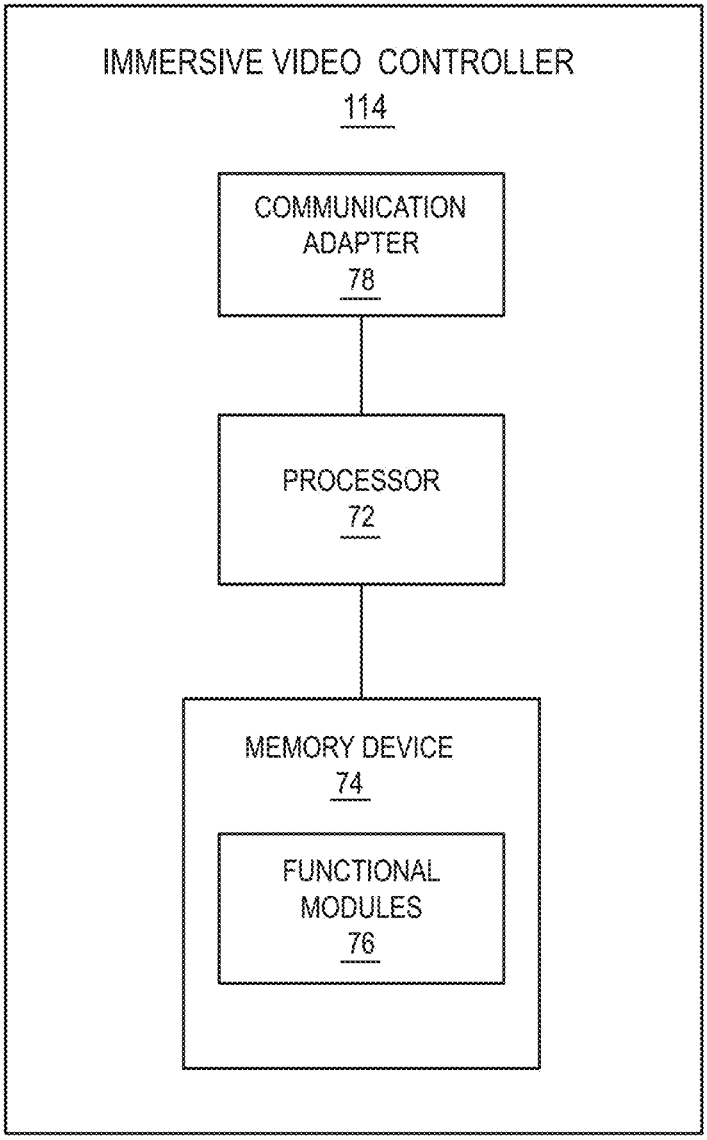
FIG. 8 is a schematic block diagram illustrating an electronic configuration for an immersive video controller according to some embodiments.

FIG. 8 is a block diagram that illustrates various components of an immersive video controller 114 according to some embodiment. As shown in FIG. 8, the immersive video controller 114 may include a processor circuit 72 that controls operations of the immersive video controller 114. Although illustrated as a single processor circuit, multiple special purpose and/or general purpose processors and/or processor cores may be provided in the immersive video controller 114. For example, the EGM 100 may include one or more of a video processor, a signal processor, a sound processor and/or a communication controller that performs one or more control functions within the EGM 100. The processor circuit 72 may be variously referred to as a "controller," "microcontroller," "microprocessor" or simply a "computer." The processor circuit 72 may further include one or more application-specific integrated circuits (ASICs).

Various components of the immersive video controller 114 are illustrated in FIG. 8 as being connected to the processor circuit 72. It will be appreciated that the components may be connected to the processor circuit 72 through a system bus, a communication bus and controller, such as a USB controller and USB bus, a network interface, or any other suitable type of connection.

The immersive video controller 114 further includes a memory device 74 that stores one or more functional modules 76 for performing the operations described above.

The memory device 74 may store program code and instructions, executable by the processor circuit 72, to control the immersive video controller 114. The memory device 74 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The immersive video controller 114 may include a communication adapter 78 that enables the immersive video controller 114 to communicate with remote devices, such as EGMs 100 and/or a player tracking server 108 (FIG. 1) over a wired and/or wireless communication network, such as a local area network (LAN), wide area network (WAN), cellular communication network, or other data communication network.

The EGM 100 may include one or more internal or external communication ports that enable the processor circuit 72 to communicate with and to operate with internal or external peripheral devices, such as display screens, keypads, mass storage devices, microphones, speakers, and wireless communication devices. In some embodiments, internal or external peripheral devices may communicate with the processor circuit 72 through a universal serial bus (USB) hub (not shown) connected to the processor circuit 72.

Embodiments described herein may be implemented in various configurations for EGMs 100*s*, including but not limited to: (1) a dedicated EGM, wherein the computerized instructions for controlling any games (which are provided by the EGM) are provided with the EGM prior to delivery to a gaming establishment; and (2) a changeable EGM, where the computerized instructions for controlling any games (which are provided by the EGM) are downloadable to the EGM through a data network when the EGM is in a gaming establishment. In some embodiments, the computerized instructions for controlling any games are executed by at least one central server, central controller or remote host. In such a "thin client" embodiment, the central server remotely controls any games (or other suitable interfaces) and the EGM is utilized to display such games (or suitable interfaces) and receive one or more inputs or commands from a player. In another embodiment, the computerized instructions for controlling any games are communicated from the central server, central controller or remote host to an EGM local processor circuit and memory devices. In such a "thick client" embodiment, the EGM local processor circuit executes the communicated computerized instructions to control any games (or other suitable interfaces) provided to a player.

In some embodiments, an EGM may be operated by a mobile device, such as a mobile telephone, tablet other mobile computing device.

In some embodiments, one or more EGMs in a gaming system may be thin client EGMs and one or more EGMs in the gaming system may be thick client EGMs. In another embodiment, certain functions of the EGM are implemented in a thin client environment and certain other functions of the EGM are implemented in a thick client environment. In one such embodiment, computerized instructions for controlling any primary games are communicated from the central server to the EGM in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal EGMs, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor circuit of the EGM executes the computerized instructions to control any games (or other suitable interfaces) displayed by the EGM.

In some embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product including one or more computer readable media having computer readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing.

More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any medium that can contain, or store a program for use by or in connection with a machine readable instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor circuit of a general purpose computer, special purpose computer, or other programmable data processing apparatus to produce a machine, such that the instructions, which execute via the processor circuit of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The invention claimed is:

1. An immersive video system comprising:

a processor circuit; and a memory coupled to the processing circuit, the memory comprising machine-readable instructions that, when executed by the processor circuit:

cause the processor circuit to determine a device location of an immersive video device being worn by a user and an electronic game machine (EGM) location for an EGM associated with the user;

cause the processor circuit to determine that the immersive video device is obstructing a view of the EGM by the user; and cause the processor circuit to determine in response to determining that the immersive video device is obstructing the view of the EGM by the user, disable a feature of the EGM.

2. The immersive video system of claim 1, wherein the memory further comprises machine-readable instructions that, when executed by the processor circuit:

cause the processor circuit to disable the feature of the EGM by disabling a display device of the EGM.

3. The immersive video system of claim 1, wherein the memory further comprises machine-readable instructions that, when executed by the processor circuit:

cause the processor circuit to disable the feature of the EGM by disabling an input device of the EGM.

4. The immersive video system of claim 1, wherein the memory further comprises machine-readable instructions that, when executed by the processor circuit:

cause the processor circuit to disable the feature of the EGM by disabling a graphical interface feature of the EGM.

5. The immersive video system of claim 1, wherein the memory further comprises machine-readable instructions that, when executed by the processor circuit:

cause the processor circuit to disable the feature of the EGM by disabling a cashout feature of the EGM.

6. The immersive video system of claim 1, wherein the memory further comprises machine-readable instructions that, when executed by the processor circuit:

cause the processor circuit to disable the feature of the EGM by disabling a service feature of the EGM.

7. The immersive video system of claim 1, wherein the memory further comprises machine-readable instructions that, when executed by the processor circuit:

in response to determining that the immersive video device is obstructing the view of the EGM by the user, cause the processor circuit to provide an indication to an operator of the EGM that the immersive video device is being worn by the user.

8. The immersive video system of claim 7, wherein the memory further comprises machine-readable instructions that, when executed by the processor circuit:

cause the processor circuit to provide the indication to the operator of the EGM that the immersive video device is being worn by the user by providing a visual indication proximate to the EGM.

9. The immersive video system of claim 7, wherein the memory further comprises machine-readable instructions that, when executed by the processor circuit:

cause the processor circuit to provide the indication to the operator of the EGM that the immersive video device is being worn by the user by transmitting the indication to an operator device.

10. The immersive video system of claim 1, wherein the memory further comprises machine-readable instructions that, when executed by the processor circuit:

cause the processor circuit to determine that an obstruction is in a predetermined area around the EGM; and cause the processor circuit to provide an indication to the user that the obstruction is in the predetermined area around the EGM.

11. The immersive video system of claim 10, wherein the memory further comprises machine-readable instructions that, when executed by the processor circuit:

cause the processor circuit to provide the indication of that the obstruction is in the predetermined area around the EGM by causing the immersive video device to display a virtual element corresponding to the obstruction to the user.

12. The immersive video system of claim 11, wherein the memory further comprises machine-readable instructions that, when executed by the processor circuit:

cause the processor circuit to display the virtual element corresponding to the obstruction displaying the virtual element in a virtual location with respect to the EGM within an immersive video scene being viewed by the user that corresponds to a real-world location of the obstruction within the predetermined area around the EGM.

13. The immersive video system of claim 1, wherein the immersive video device is a virtual reality (VR) device, and wherein the memory further comprises machine-readable instructions that, when executed by the processor circuit:

cause the processor circuit to determine that the immersive video device is obstructing a view of the EGM by the user by determining that the VR device is occupying an entire field of view of the user wearing the VR device.

14. The immersive video system of claim 1, wherein the immersive video device is a mixed reality device, and wherein the memory further comprises machine-readable instructions that, when executed by the processor circuit:

cause the processor circuit to determine that the immersive video device is obstructing a view of the EGM by the user comprises determining that a virtual element being displayed by the mixed reality device is obstructing the view of the EGM by the user.

15. The immersive video system of claim 1, wherein the memory further comprises machine-readable instructions that, when executed by the processor circuit:

cause the processor circuit to determine that the immersive video device is obstructing a view of the EGM by the user by detecting that the immersive video device is being worn by the user.

16. The immersive video system of claim 15, wherein the memory further comprises machine-readable instructions that, when executed by the processor circuit:

cause the processor circuit to detect that the immersive video device is being worn by the user comprises detecting a movement of the immersive video device.

17. The immersive video system of claim 1, wherein the memory further comprises machine-readable instructions that, when executed by the processor circuit:

in response to determining that the immersive video device is video device is obstructing the view of the EGM by the user, cause the processor circuit to lock a storage compartment associated with the EGM.

18. The immersive video system of claim 1 further comprising a first EGM comprising the processor circuit and the memory.

19. An immersive video device comprising:

a head-wearable frame;

a display coupled to the head-wearable frame;

a processor circuit;

a communication interface coupled to the processor circuit; and a memory coupled to the processor circuit, the memory comprising machine-readable instructions that, when executed by the processor circuit:

cause the processor circuit to determine a device location of the immersive video device and an electronic game machine (EGM) location for an EGM associated with a user wearing the immersive video device;

cause the processor circuit to determine that the immersive video device is obstructing a view of the EGM by the user; and cause the processor circuit to, in response to determining that the immersive video device is obstructing the view of the EGM by the user, transmit an instruction to the EGM via the communication interface to disable a feature of the EGM.

20. A method comprising:

determining, by a processor circuit, a device location of an immersive video device being worn by a user and an electronic game machine (EGM) location for an EGM associated with the user;

determining, by the processor circuit, that the immersive video device is obstructing a view of the EGM by the user; and in response to determining that the immersive video device is obstructing the view of the EGM by the user, disabling a feature of the EGM.

* * * * *